US010315321B2

(12) United States Patent
Frierson

(10) Patent No.: US 10,315,321 B2
(45) Date of Patent: Jun. 11, 2019

(54) CLIPPER HOLDER

(71) Applicant: Harvey L Frierson, Mathews, NC (US)

(72) Inventor: Harvey L Frierson, Mathews, NC (US)

( * ) Notice: Subject to any disclaimer, the term of this patent is extended or adjusted under 35 U.S.C. 154(b) by 0 days.

(21) Appl. No.: 15/636,305

(22) Filed: Jun. 28, 2017

(65) Prior Publication Data

US 2019/0001513 A1 Jan. 3, 2019

(51) Int. Cl.

| | |
|---|---|
| ***A47F 7/00*** | (2006.01) |
| ***B26B 19/38*** | (2006.01) |
| ***A45D 27/29*** | (2006.01) |
| ***A45D 44/02*** | (2006.01) |
| *A45D 27/00* | (2006.01) |

(52) U.S. Cl.

CPC ..... *B26B 19/3833* (2013.01); *A45D 27/29* (2013.01); *A45D 44/02* (2013.01); *A47F 7/00* (2013.01); *A45D 27/00* (2013.01)

(58) Field of Classification Search

CPC ..... A47F 7/00; A45D 27/00; A45D 44/02; A45D 27/29; B26B 19/3833

USPC ..... 211/181.1, 74, 75, 70.6, 87.01; 206/477–483, 495; 248/309.7, 314, 248/316.8; 30/537, 541

See application file for complete search history.

(56) References Cited

U.S. PATENT DOCUMENTS 72,758 A * 12/1867 Reistle ..... A47B 73/00 211/74
169,962 A * 11/1875 Cross ..... A47F 5/0037 211/81
192,618 A * 7/1877 Connor ..... A47F 7/0028 211/60.1
199,294 A * 1/1878 Jenness ..... A47G 25/10 211/32
348,983 A * 9/1886 Mack ..... A47G 25/10 211/32
379,961 A * 3/1888 Lasing ..... A47L 13/512 248/112
396,984 A * 1/1889 Chandler ..... B65D 61/00 248/135
591,078 A * 10/1897 Jewell ..... B62H 3/12 211/19
593,312 A * 11/1897 Schandein ..... A47B 73/00 211/74

(Continued)

*Primary Examiner* — Jonathan Liu
*Assistant Examiner* — Devin K Barnett
(74) *Attorney, Agent, or Firm* — F. Rhett Brockington

(57) ABSTRACT

A clipper holder, for electrical hair clippers, includes an upper enclosure with a major arc element having a diameter to accommodate the clipper. Left and right portions of the major arc element terminate in opposing blunt ends. The space between the opposing ends is wide enough to allow passage of the clipper's cord. A lower enclosure has a smaller major arc element that is coplanar and coaxial with the upper enclosure. The smaller major arc element can accommodate the clipper's cord. Left and right portions of the smaller major arc element are contiguous with curvilinear portions that extend forward, curving upward toward the opposing blunt ends, finishing as vertical extensions with blunt tips. The vertical extensions prevent forward movement of an enclosed clipper. The smaller major arc element prevents movement anywhere else but up. An angled connecting rear rod supports the enclosures and is attached to a mounting plate.

7 Claims, 8 Drawing Sheets

(56) References Cited

U.S. PATENT DOCUMENTS 806,906 A * 12/1905 Nelson ..... A47G 25/10 206/8
D40,361 S * 11/1909 Moore ..... 211/74
939,352 A * 11/1909 Truitt ..... A47G 25/10 211/181.1
1,017,102 A * 2/1912 Kaufman ..... 211/74
1,053,103 A * 2/1913 Martus ..... B60N 3/102 180/68.5
1,084,966 A * 1/1914 Rodes ..... A47C 3/30 248/185.1
1,165,840 A * 12/1915 Brutus ..... A62C 13/78 211/74
1,222,486 A * 4/1917 Swanson ..... A47G 29/18 211/74
1,225,870 A * 5/1917 Schwing ..... A47B 73/00 211/74
1,235,358 A * 7/1917 Mayfield ..... A47B 73/00 211/74
1,236,929 A * 8/1917 Hauck ..... A47G 29/18 211/74
1,268,867 A * 6/1918 Mojonnier ..... A47B 73/00 211/74
1,311,966 A * 8/1919 Hannon ..... A47G 7/044 211/74
D53,853 S * 9/1919 Kimmel ..... 211/74
1,362,831 A * 12/1920 Altenberg ..... B67D 3/02 141/360
1,389,984 A * 9/1921 Reed ..... A47J 47/16 211/104
1,393,843 A * 10/1921 Smith ..... A47G 25/06 211/32
1,480,085 A * 1/1924 Linard ..... A62C 8/005 169/35
1,490,477 A * 4/1924 Morrow ..... B65D 55/02 211/74
1,544,291 A * 6/1925 Wright ..... A61J 9/0684 211/181.1
1,597,548 A * 8/1926 Sharp ..... A47F 3/145 211/74
1,926,201 A * 9/1933 Kahns ..... A47G 25/0607 211/31
1,954,846 A * 4/1934 Schmidt ..... A47C 7/64 211/32
D93,309 S * 9/1934 Van Aken ..... 211/32
1,974,735 A * 9/1934 Botham ..... A47F 5/02 211/74
1,992,411 A * 2/1935 Bruce ..... B65D 85/305 206/202
1,992,657 A * 2/1935 Fontan ..... A47G 23/025 131/241
1,993,702 A * 3/1935 Brunhoff ..... A47G 23/0225 131/241
2,070,417 A * 2/1937 Whenham ..... A47G 25/02 211/180
2,140,743 A * 12/1938 Heymann ..... A47G 23/0208 211/74
2,166,523 A * 7/1939 Gaebel ..... A47G 1/164 211/87.01
2,174,093 A * 9/1939 Perlman ..... A47J 31/44 211/74
2,180,042 A * 11/1939 Ettinger ..... A61M 3/0241 211/74
2,191,782 A * 2/1940 Valane ..... A61G 7/05 211/74
2,213,747 A * 9/1940 Solt ..... A47F 5/08 248/300
2,340,645 A * 2/1944 Creed ..... A61J 9/0684 211/74
D153,090 S * 3/1949 Sexton ..... 211/74
2,471,825 A * 5/1949 Long ..... B26B 19/3806 174/135
2,474,899 A * 7/1949 Hutt ..... B26B 19/3806 191/12.4
2,496,473 A * 2/1950 Hunt ..... A47G 25/24 211/32
D157,780 S * 3/1950 Oppermann ..... 248/110
2,536,419 A * 1/1951 Brunell ..... B67C 11/00 141/341
2,562,443 A * 7/1951 Barbour ..... A24F 19/0092 211/74
2,591,362 A * 4/1952 Koch ..... A47G 7/041 206/423
2,615,577 A * 10/1952 Bartleman ..... B25H 3/04 211/70.6
2,616,568 A * 11/1952 Bundgus ..... A47G 23/025 211/74
2,659,489 A * 11/1953 Searles ..... B60R 7/10 211/32
2,708,062 A * 5/1955 Poyer ..... B60N 3/103 211/74
2,926,879 A * 3/1960 Dietrich ..... A47G 23/0225 224/406
2,992,805 A * 7/1961 Weldon ..... A45D 27/29 248/314
3,011,649 A * 12/1961 Porter ..... A24F 15/00 224/400
3,104,040 A * 9/1963 Stevens ..... B60R 7/08 211/106
3,131,011 A * 4/1964 Rittenberry ..... A47B 69/00 108/28
3,184,198 A * 5/1965 Eldon ..... E04H 17/00 248/222.51
D221,960 S * 9/1971 Stephenson ..... D6/526
3,734,439 A * 5/1973 Wintz ..... A47G 23/0241 131/241
D233,723 S * 11/1974 Gutierrez ..... 141/364
3,986,695 A * 10/1976 Hronas ..... A47F 7/285 248/222.51
D262,678 S * 1/1982 DeBoer ..... D6/566
4,376,486 A * 3/1983 Arcadi, Jr. ..... A47F 7/08 211/35
D268,500 S * 4/1983 Kraus ..... D15/140
4,437,596 A * 3/1984 Shook ..... B62J 11/00 224/414
4,708,273 A * 11/1987 Grant ..... A45F 5/02 220/741
4,830,240 A * 5/1989 Tackles ..... B62J 11/00 224/414
5,002,190 A * 3/1991 Moreland ..... A47G 25/10 211/106
5,080,240 A * 1/1992 Williams ..... B25H 3/04 211/13.1
5,170,981 A * 12/1992 Lin ..... B62J 11/00 224/414
5,344,055 A * 9/1994 Edwards ..... A43B 5/16 224/401
5,392,971 A * 2/1995 Hsu ..... B62J 11/00 224/414
5,425,484 A * 6/1995 Kawand ..... B62J 11/00 220/903
5,426,570 A * 6/1995 Davis ..... B62J 6/00 224/414
5,427,285 A * 6/1995 Kreitzman ..... B62J 11/00 220/739
5,538,144 A * 7/1996 Reed ..... A47F 7/06 211/32
5,601,268 A * 2/1997 Dunchock ..... B60N 3/102 224/926
5,618,018 A * 4/1997 Baniak ..... B60N 3/102 224/483
5,704,525 A * 1/1998 Barro ..... B62J 11/00 224/414
5,794,799 A * 8/1998 Collins ..... A45D 1/20 211/60.1
5,806,822 A * 9/1998 Schulz ..... A61B 90/50 211/70.6

(56) References Cited

U.S. PATENT DOCUMENTS 5,810,228 A * 9/1998 Brokering ..... B62J 11/00 224/414
5,813,579 A * 9/1998 Hendrickson ..... B60N 3/103 224/42.11
5,833,194 A * 11/1998 Jones ..... B60N 3/103 248/311.2
5,839,632 A * 11/1998 Koday ..... B62J 11/00 224/414
D404,526 S * 1/1999 Motta ..... D28/46
5,924,579 A 7/1999 DuPont
D423,845 S * 5/2000 Coffin ..... D6/526
6,129,221 A * 10/2000 Shaha ..... A47B 81/00 211/87.01
D435,185 S * 12/2000 Winchester ..... D6/567
D464,222 S * 10/2002 Coffin ..... D6/526
6,837,407 B1 * 1/2005 Towers ..... B62J 9/005 220/840
D564,272 S * 3/2008 Quach ..... D6/526
D585,224 S * 1/2009 Hwang ..... D6/553
7,533,860 B2 * 5/2009 Somuah ..... B60N 3/102 206/217
8,028,876 B2 * 10/2011 Carpenter ..... B62J 11/00 224/413
8,052,108 B2 * 11/2011 Ahn ..... A61B 8/00 248/309.1
D699,473 S * 2/2014 Szczepanowski ..... D6/526
8,668,178 B2 * 3/2014 Ziaylek ..... F17C 13/084 224/570
D778,635 S * 2/2017 Pan ..... D6/535
2001/0042767 A1 * 11/2001 Campagnolo ..... B62J 11/00 224/414
2002/0179662 A1 * 12/2002 Young ..... B62J 11/00 224/414
2004/0256428 A1 * 12/2004 Meggiolan ..... B62J 11/00 224/414
2008/0035590 A1 * 2/2008 Huang ..... B25H 3/006 211/70.6
2008/0054030 A1 * 3/2008 Diaz ..... B44D 3/14 224/148.7
2009/0158596 A1 * 6/2009 Ouchi ..... B26B 19/102 30/45
2009/0183379 A1 * 7/2009 Johnson ..... A45D 27/24 30/538
2010/0038390 A1 * 2/2010 Chang ..... B62J 11/00 224/425
2010/0237118 A1 * 9/2010 Altshuler ..... B62J 11/00 224/414
2012/0012626 A1 * 1/2012 McKaig ..... B62J 11/00 224/425
2012/0125963 A1 * 5/2012 Awh ..... B62J 11/00 224/457
2012/0234782 A1 * 9/2012 Roskuszka ..... B21D 11/10 211/85.18
2012/0292272 A1 * 11/2012 Hirst ..... A47K 1/09 211/65
2013/0126569 A1 * 5/2013 Huang ..... B62J 11/00 224/414
2013/0307246 A1 * 11/2013 Jankura ..... B62J 11/00 280/281.1
2014/0231479 A1 * 8/2014 VanZanten ..... B62J 11/00 224/441
2014/0360955 A1 * 12/2014 Presenty ..... A47B 96/1466 211/75
2016/0046341 A1 * 2/2016 Briney ..... B62J 11/00 224/414

* cited by examiner

CLIPPER HOLDER

BACKGROUND OF THE INVENTION

1. Field of the Invention

The invention relates generally to a clipper holder for electric hair clippers, wherein the clipper holder can be mounted on a shelf edge or a wall, individually or in groups on a rack.

2. Background

Barber/stylist have a plurality of sizes of clippers, where each size is specialized for a certain type of cut; and where often each size has a backup hair clipper. The background of clipper racks and clipper holders can be found in U.S. Pat. No. 5,924,579 to Jeffrey K. DuPont. Dupont teaches that each holder has two side retaining arms respectively extending from opposite ends of the back support bar generally orthogonal to the back support bar and in proximity to the sides of the hair clipper, thereby preventing the hair clipper from sliding out the structure while in resting engagement with the back support bar; two base retaining arms respectively extending from opposite ends of the base support bar generally orthogonally to the base support bar and in proximity to the lower front of the hair clipper, thereby preventing the hair clipper from sliding frontwardly out of the structure while in resting engagement with the base support bar; and a connecting bar extending between and connecting together the base support bar and the back support bar.

DuPont teaches a structure that is designed to receive and retain a particular size electric hair clipper, and that the two side retaining arms are generally orthogonal to the back support bar. Each of the structures is angled so that when fitted with a hair clipper the hair clipper rests at an angle no greater than about 60 degrees, where upright is 90 degrees. In an upright position the hair clipper would fall forward out of the structure as the clipper blade projects forward and is above the clipper body.

The structure taught by DuPont has structural limitations. The projecting two side retaining arms terminate in what are essentially prods, which is problematic for repetitive hand movements, cleaning, and inexperienced users. Furthermore, the cradle-like structure is not amenable to a more space saving upright mountable holder, and the mounted rack requires an edge which necessitates the use of both a horizontal and a vertical surface. There is no teaching of capability to mount DuPont's rack to either a horizontal surface (counter or table top) or a vertical surface (wall), only an edge.

In the specification geometric terminology is used, and some of the terms are not commonly used. A circle is associated with a complete rotation of an arc through 360°. A semi-circle is associated with a half arc having a rotation through 180°. Minor arcs are associated with less than half of a rotation, so minor arcs are associated with angles less than 180°. Major arcs are associated with more than half of a rotation, but less than 360°. In geometry, a chord is the length between the ends of an arc, including minor arcs, major arcs, and semicircular arcs. Arcs are terms of the art for ellipses as well as circles, wherein an ellipse can have a uniform radius in all directions and, therefore, a circle is a special type of ellipse, where the eccentricity is zero. Most ellipses are not circles. Typically, the radius on a horizontal coordinate is different than on a vertical coordinate. For example a semi-elliptical arc has a rotation which is 180°, but it can have a radius that is longer along one coordinate than along an orthogonal coordinate, or they could be the same. The term semi-elliptical includes both possibilities. Also, in discussing 3-D structures, arch is typically employed instead of arc, but within the metes and bounds of this specification the term arc will be used.

SUMMARY OF THE INVENTION

A first object of the invention is that the clipper holder provides for securing clippers in an upright or an angled position.

A second object of the invention is that the clipper holder has no protruding unprotected ends. If the clipper holder has an end, the end is not protruding and/or is protected by a structural element. For example, opposing ends of a major arc are not protruding and/or are protected, as one is at least partially blocked by the other opposing end.

A third object of the invention is to provide a clipper holder that can be mounted to a horizontal surface, a vertical surface, or an edge surface.

A fourth object of the invention is that the clipper holder can be combined with other clipper holders, and when mounted together, form a rack.

A fifth object of the invention is that the clipper holder can accommodate a variety of different sized hair clippers.

BRIEF DESCRIPTION OF THE DRAWINGS

The foregoing invention will become readily apparent by referring to the following detailed description and the appended drawings in which.

DETAILED DESCRIPTION OF THE INVENTION

The invention is a clipper holder for an electrical hair clipper. Electric hair clippers are driven by an electric motor which makes the blades oscillate from side to side. There are at least three different motor types that are used in clipper production: magnetic, rotary and pivot. Rotary style may be driven by direct current or alternating current electricity source. Both magnetic and pivot style clippers use magnetic forces derived from winding copper wire around steel. Alternating current creates a cycle attracting and relaxing to a spring to create the speed and torque to drive the clipper cutter across the combing blade. Some electric clippers utilize a power source, like rechargeable batteries, and require intermittent connection to a charging cord, typically when they are in a clipper holder.

Substantially all electric hair clippers have a static comb covering the oscillating blades. The static comb is affixed to a housing for the electrical components. Traditionally, the housing is referred to as the body. In many cases, but certainly not all, an upper body of the clipper has a width that tapers toward a lower body, ending in an attenuated width. The body terminates with an electrical cord having a cord width which is selected from a strain relief width or a recharging cord connector width for clippers having rechargeable batteries. In newer style clippers instead of being tapered, the body is closer to being cylindrical. The disclosed clipper holder can accommodate existing and anticipated forms of the body.

Figure 2:
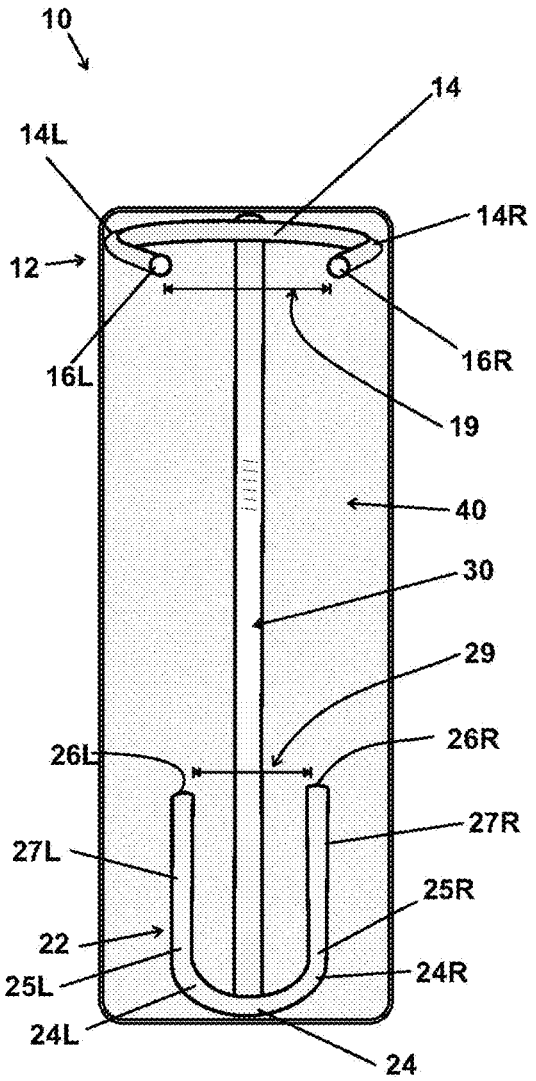
FIG. 2 is a plan overhead view of the clipper holder shown in FIG. 1.
Figure 1:
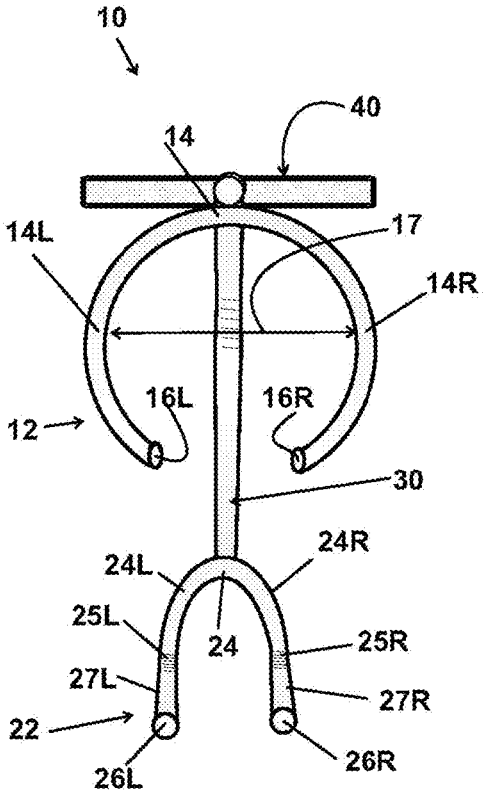
FIG. 1 is a frontal view of a clipper holder, illustrating the holder mounted to a planar plate and positioned in a substantially vertical position.

The clipper holder 10 as shown in FIG. 1 includes: an upper enclosure 12 of a sturdy material, such as a relatively stiff metal wire, formed into a major arc element 14 having a diameter 17 that is sufficiently large to accommodate the upper body of the electrical hair clipper, wherein a left portion 14L of the major arc element terminates in a blunt left end 16L, and a right portion 14R of the major arc element 14 terminates in a blunt right end 16R. As shown in FIG. 1 and FIG. 2, the blunt left and right ends are opposing 16L, 16R versus projecting, and an open space between the blunt left end and the blunt right end defines an upper frontal opening 19 that is sufficiently wide to allow the passage of an electrical cord. The length of the upper frontal opening is the chord length of the major arc element 14. As is readily seen the major arc element is approximately 290 degrees±about 60 degrees. The illustrated sturdy material is a steel wire having a gauge of about 6±about 2.

Figure 8:
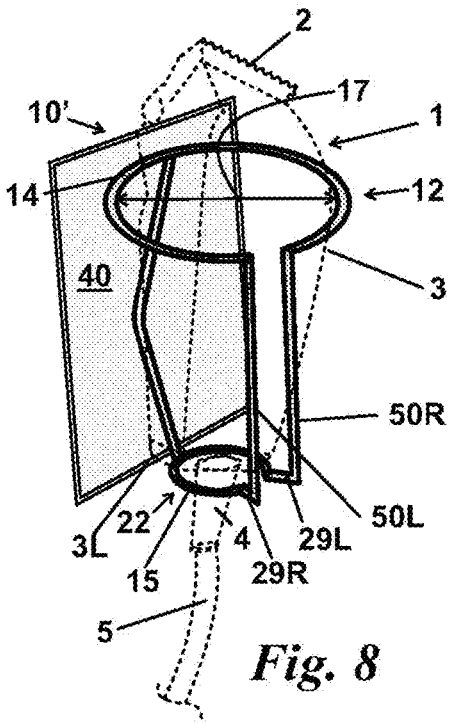
FIG. 8 is a perspective frontal view of the clipper holder shown in FIG. 7, illustrating the clipper holder mounted to a substantially vertical surface, wherein a conventional electric hair clipper is shown in ghost using dashed lines.
Figure 9:
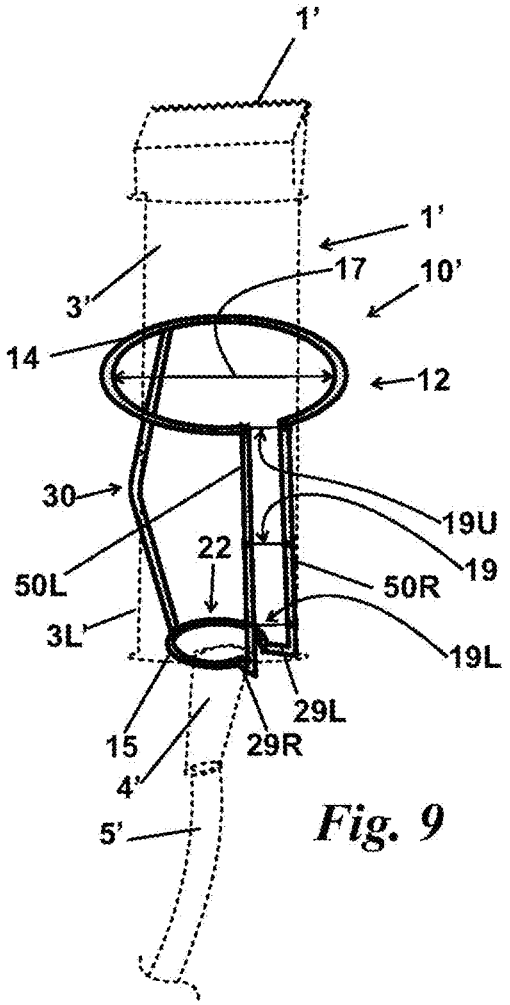
FIG. 9 is a perspective frontal view of the clipper holder shown in FIG. 7, illustrating an unmounted clipper holder in a substantially upright position, wherein a professional electric hair clipper having a cylindrical body is shown in ghost using dashed lines.

A lower enclosure 22 having a similar sturdy material is formed into a semicircular arc element 24 that is about coplanar and coaxial with the upper enclosure 12. The semicircular arc element 23 has a smaller diameter, but it is sufficiently large to accommodate the cord width of the electrical hair clipper. An exemplary electrical cord width is illustrated in FIGS. 8 and 9. See the strain relief 4 and the electrical cord 5 in FIGS. 8 and 9. A left portion 24L of the semicircular arc element 24 is contiguous with a left curvilinear portion 25L that extends forward, and then curves upward toward the blunt left end 16L of the upper enclosure 12 terminating in a left vertical straight extension 27L with a blunt left tip 26L, a right portion 24R of the semicircular arc element 24 contiguous with a right curvilinear portion 25R that extends forward, and then curves upward toward the blunt right end 16R of the upper enclosure 12 terminating in a right vertical straight extension 27R with a blunt right tip 26R. The right vertical straight extension 27R is parallel to the left vertical extension 27L, and a slot between the left vertical straight extension and the right vertical straight extension defines a lower frontal opening 29 that is sufficiently wide to allow the passage of the electrical cord. The left and right vertical straight extensions 27L, 27R restrain an inserted hair clipper 1 from moving forward and the semicircular arc element 24 prevents the hair clipper from moving left, right or rearward as the electrical cord is projecting through the semicircular arc element of the lower enclosure 22 (see FIGS. 8 and 9 to see the position of the strain relief 4 and electrical cord 5).

Figure 3:
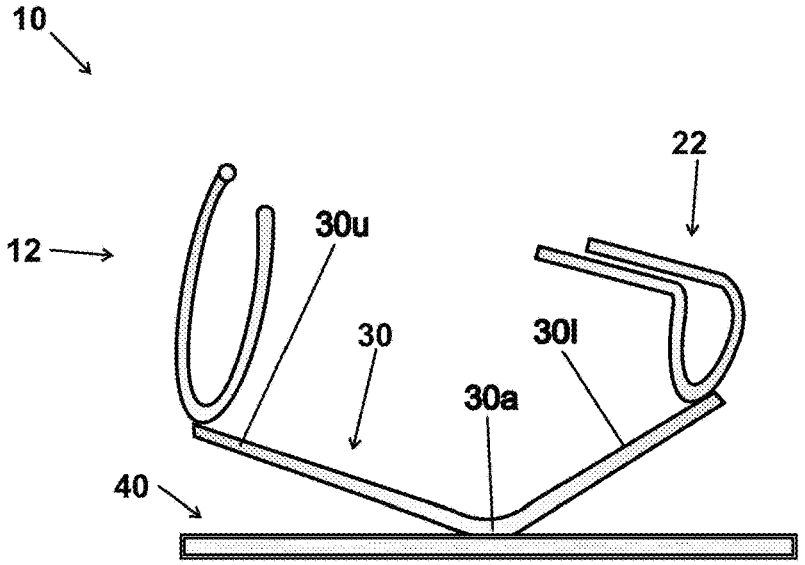
FIG. 3 is a side perspective view of the clipper holder shown in FIG. 1, illustrating the clipper holder mounted to a planar plate that is mounted to a horizontal surface.

As best viewed in FIG. 3, a rod 30, which is an angled connecting rear metal wire$_L$ provides support for the upper enclosure 12 and the lower enclosure 22, wherein an upper end of an inclined upper section 30*u* of the rod 30 is welded to a rear mid-way perimeter portion of the upper enclosure 12, bends at the apex section 30*a*, and angles inward to compensate for the smaller diameter of the lower enclosure 22, wherein a lower end of an inclined lower section 301 of the rod is welded to a rear mid-way perimeter portion of the lower enclosure 22.

Figure 4:
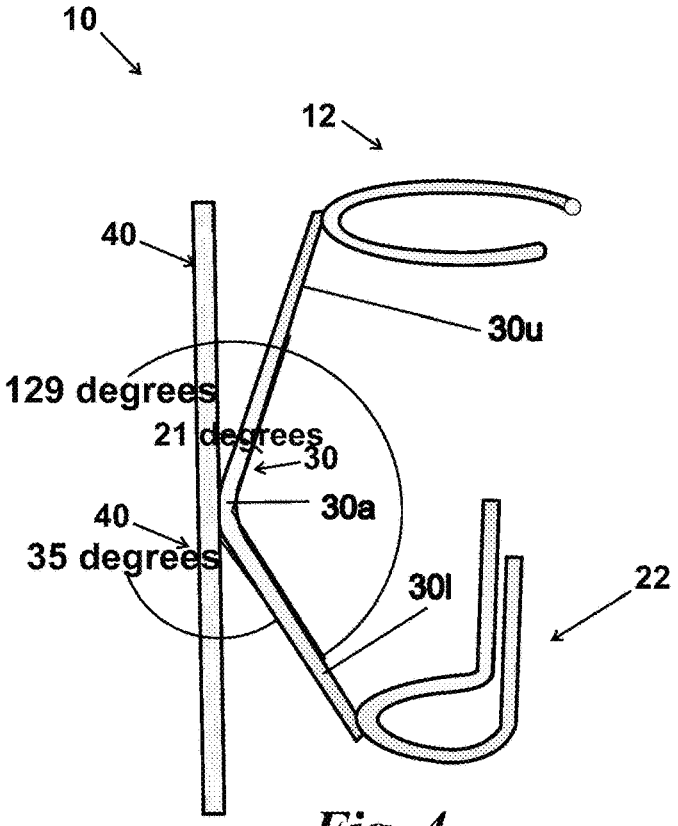
FIG. 4 is a side perspective view of the clipper holder shown in FIG. 1, illustrating the clipper holder mounted to a planar plate that is mounted to a vertical surface.

As shown in FIG. 4 the angled rod 30 of the clipper holder enables it to be mounted on both horizontal and vertical surfaces. In the illustrated embodiment the angled rod 30 is bent about 60±9 degrees from straight. The illustrated lower angle is slightly more obtuse with respect to the mounting plate 40, about 35 degrees±about 4 degrees, than the upper angle, which is about 21 degrees±about 4 degrees.

The clipper holder includes a mounting plate 40 for mounting one or more clipper holders to a surface, wherein the surface can be vertical, horizontal, or angled. The angled connecting rear metal wire rod 30 is welded directly to the mounting plate 40 or alternatively to components on the mounting plate. The mounting plate is subsequently fastened to the surface. The illustrated mounting plate 40 in FIGS. 1-4 is substantially planar.

Figure 5:
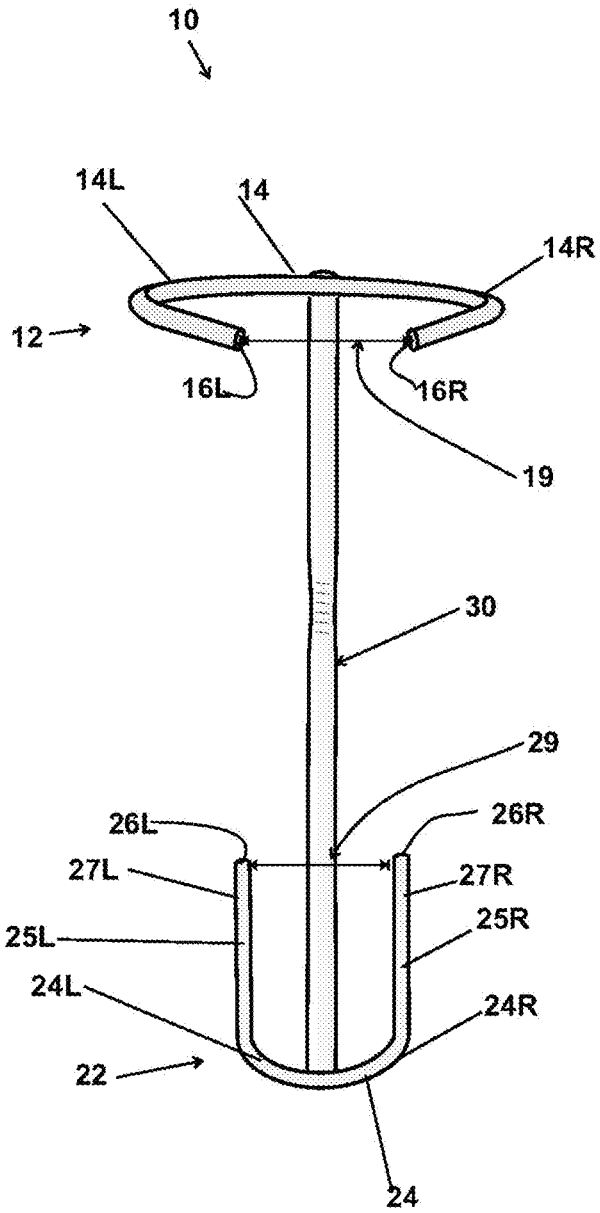
FIG. 5 is a frontal view of an unmounted clipper holder having a larger upper enclosure to accommodate a larger hair clipper.
Figure 6:
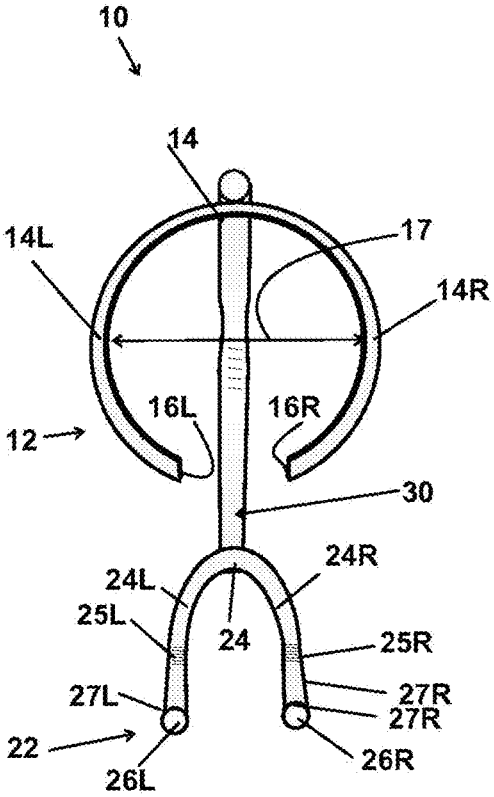
FIG. 6 is a plan overhead view of the clipper holder shown in FIG. 5.

FIGS. 5 and 6 illustrate an embodiment wherein the upper enclosure 12 has a larger diameter than the embodiment shown in FIGS. 1-4, however the chord length 19 is still about the same. In general, the chord size doesn't change as much as the body of the clippers.

Figure 7:
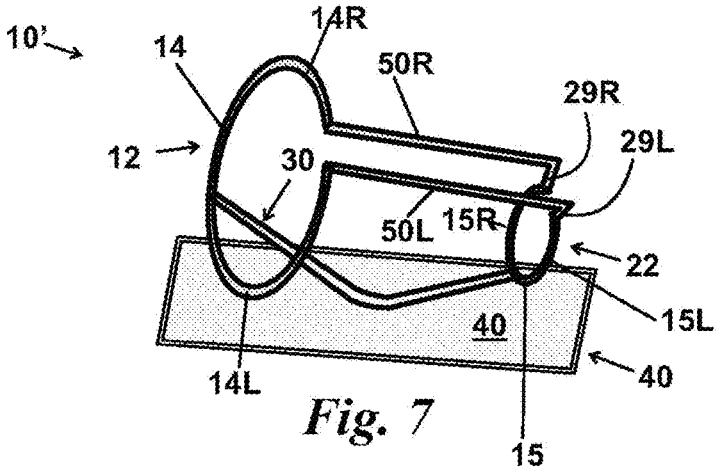
FIG. 7 is a side perspective view of a clipper holder with left and right frontal portions and no blunt ends or blunt tips, wherein the clipper holder is mounted on a substantially horizontal surface.

A second embodiment of a clipper holder is illustrated in FIGS. 7-9, wherein the clipper holder has no tips or blunt ends. As before the holder is for an electrical hair clipper having an upper body width and a lower body width that terminates with an electrical cord having a cord width which is selected from a strain relief width or a recharging cord connector width.

The clipper holder includes: an upper enclosure 12 of a first metal wire, of a sturdy gauge, formed into a major arc element 14 having a diameter 17 that is sufficiently large to accommodate the upper body 3, 3' of the electrical hair clipper 1 as shown in FIG. 8, and electrical hair clipper 1' as shown in FIG. 9. A left portion 14L of the major arc element 14 concludes, continuing as a left downwardly curved frontal curvilinear element that is contiguously adjoined with a left vertical extension described below. A right portion 14R of the major arc element 14 concludes, continuing as a right downwardly curved frontal curvilinear element that is contiguously adjoined with a right vertical extension as described below, wherein the left downwardly curved frontal curvilinear element and the right downwardly curved frontal curvilinear element define an upper frontal opening 19U as shown in FIG. 9 that is sufficiently wide to allow the passage of the electrical cord. The upper frontal opening is nominally comparable the equivalent to the chord length previously discussed.

A lower enclosure 22 of a second metal wire, also of a sturdy gauge, formed into a smaller major arc element 15 that is about coplanar and coaxial with the upper enclosure having a diameter that is smaller but sufficiently large to accommodate the cord width of the electrical hair clipper, a left portion 15L of the smaller major arc element contiguous with a left curvilinear portion 29L that extends forward, and then curving upward, toward the left downwardly curved frontal curvilinear element of the upper enclosure, forming the left vertical extension which is contiguous with the left downwardly curved frontal curvilinear element taken together form a left frontal portion 50L, a right portion 15R of the smaller major arc element 15 contiguous with a right curvilinear portion 29R that extends forward, and then curving upward, toward the right downwardly curved frontal curvilinear element of the upper enclosure, forming the right vertical straight extension which is contiguous with the right downwardly curved frontal curvilinear element taken together form a right frontal portion 50R, wherein the right frontal portion and the left frontal portion are about parallel and have a lower opening 19L, and a slot between the left frontal portion and the right frontal portion defines a vertical frontal opening 19 that is sufficiently wide to allow the passage of the electrical cord, the left frontal portion 50L and the right frontal portion 50R retain the hair clipper(s) 1, 1' from moving forward and an appropriately sized hair clipper is held about axially in the clipper holder 10'. The smaller major arc 15 of the lower enclosure 22 centers the clipper's stain relief 4, 4' of the electrical cord 5, 5', which in turn restrains the lower body 3, 3' of the clipper as illustrated in FIG. 8 and FIG. 9. The clipper 1' in FIG. 9 is illustrative of a profession grade hair clipper, and has a substantially cylindrical body.

The angled connecting rear metal wire rod 30 provides support for the upper enclosure 12 and the lower enclosure 22, wherein an upper end of the rod is welded to a rear mid-way perimeter portion of the major arc element 14 and extends about outwardly downward from the upper enclosure 12 and angles inward compensating for the smaller diameter of the lower enclosure, wherein a lower end of the rod is welded to a rear mid-way perimeter portion of the smaller major arc element.

As shown in FIG. 7 and FIG. 8 the holder has a mounting plate 40 for mounting one or more clipper holders to a surface, wherein the surface can be vertical, horizontal, or angled, wherein the angled connecting rear metal wire rod is welded directly to the mounting plate or alternatively to components of the mounting plate, which is subsequently fastened to the surface.

Figure 10:
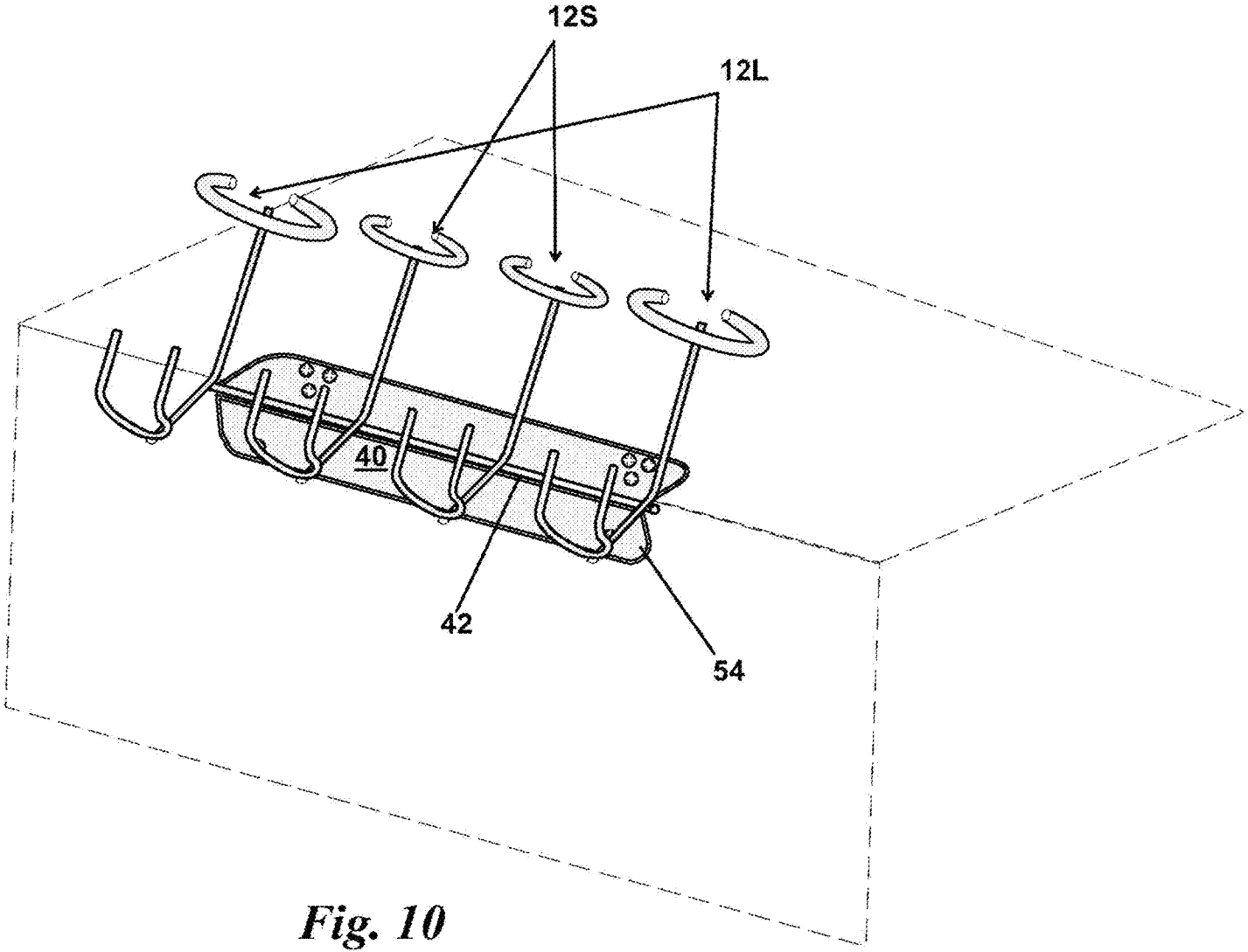
FIG. 10 is a perspective frontal view of a clipper holder rack having an L-angled plate mounted to an edge, wherein the holders on ends of the plate are larger than the two medial clipper holders.

FIG. 10 illustrates a rack of four clipper holders. The rack of four clipper holders has an L-angled plate 54 version of the mounting plate 40, so that it can be mounted to an edge intersection of a horizontal surface and a vertical surface. In the illustrated rack the clipper holders on opposing ends of the plate are larger than the two medial clipper holders. The angled plate has holes for fastening elements, and the angled connecting rear metal wire rod is welded to an external fold 42 of the angled plate.

Figure 11:
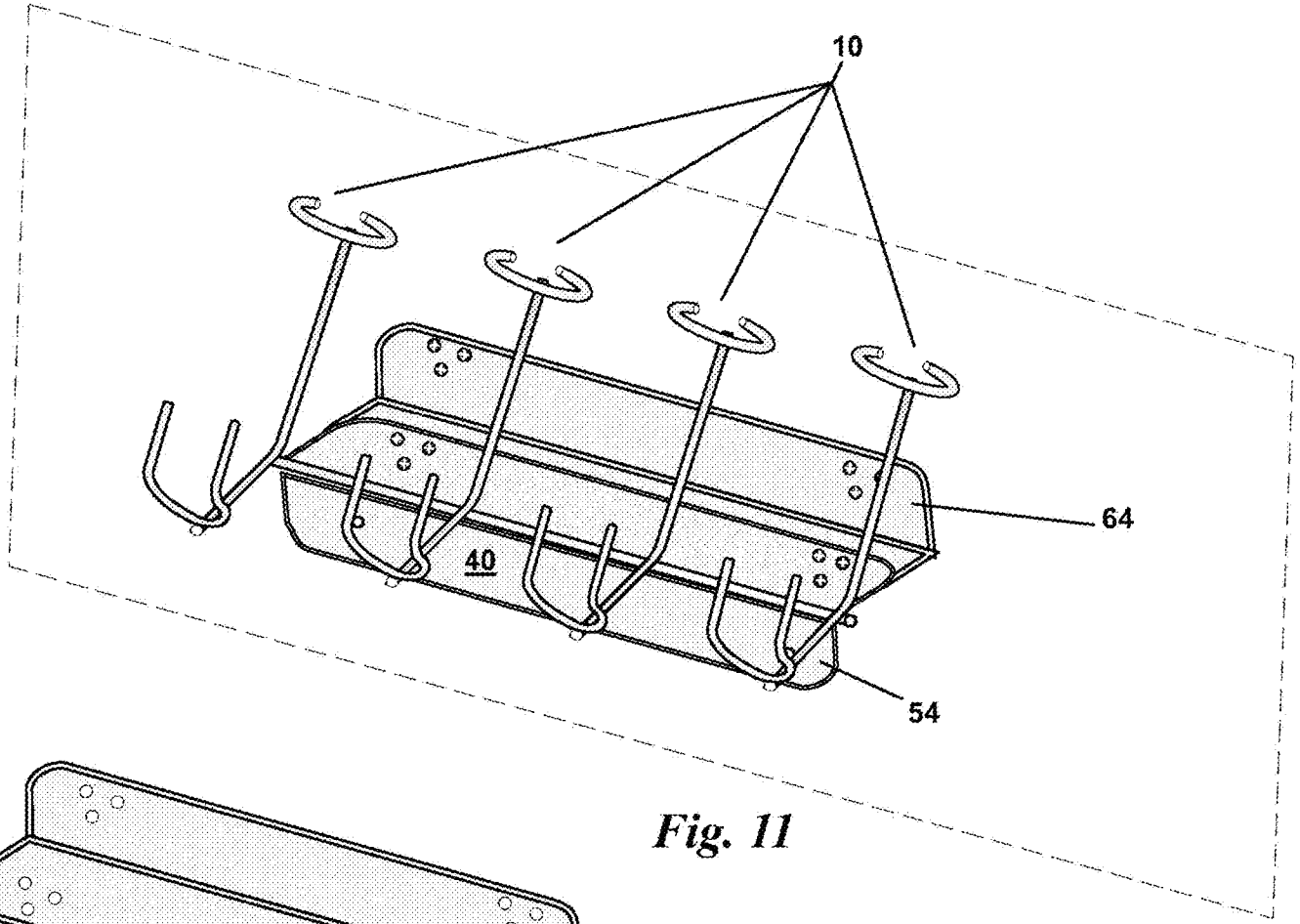
FIG. 11 is a perspective frontal view of a clipper holder rack having an L-angled plate, which has been attached to an L-angled bracket, shown separately in FIG. 11*a*, and the rack utilizing the L-angled bracket is mounted to a vertical surface indicated by the dashed line.
Figure 11A:
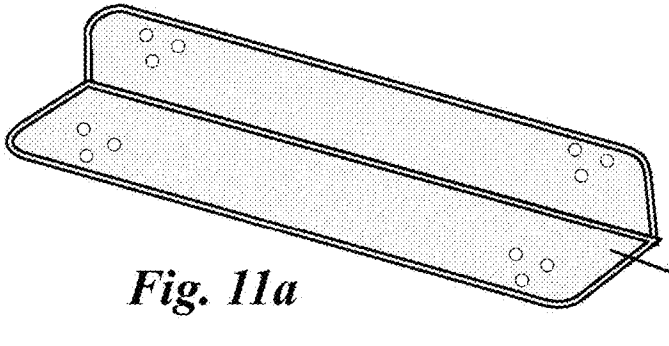
FIG. 11*a* is a perspective frontal view of the L-angled bracket.

FIG. 11 illustrates the rack with four clipper holders shown in FIG. 10, which is now attached to an L-angled bracket 64 shown separately in FIG. 11*a*. The rack is mounted to a vertical surface indicated by the dashed line.

FIG. 11*a* illustrates the L-angled bracket 64.

Figure 12:
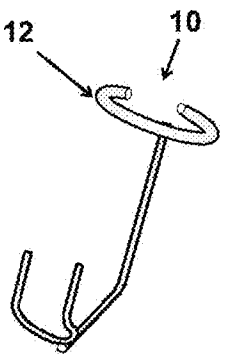
FIG. 12 is a perspective frontal view of a clipper holder (without a mounting plate) that has a smaller upper enclosure.

A clipper holder without a mounting plate has a smaller upper enclosure 12, and is illustrated in FIG. 12.

As a guideline, the diameter of the major arc element of the upper enclosure is from about 1.25 inches to about 2.75 inches, and the diameter of the semicircular arc element of the lower enclosure is from about 0.875 inches to about 1.25 inches. The gauge of the metal wire is about 6±about 2, wherein the metal wire is steel. The steel can be powder coated or dipped to apply paint and/or a rubbery protective coating. The selected coating preferably does not hold a static electricity charge, as this will tend to effect an accumulation of clippings.

In general, the clipper holders on a rack are separated equidistance from each other, where equidistance is measured from adjoining perimeters of an outside diameter of the major arc element of the upper enclosure.

Figure 13:
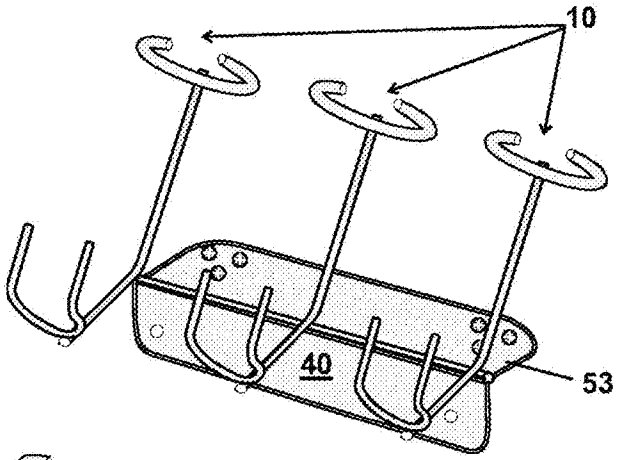
FIG. 13 is a perspective frontal view of a clipper holder rack having an L-angled plate, wherein the rack has three clipper holders.

The rack in FIG. 13 has an L-angled plate 53 version of the generic mounting plate 40, wherein the rack has three clipper holders.

Figure 14:
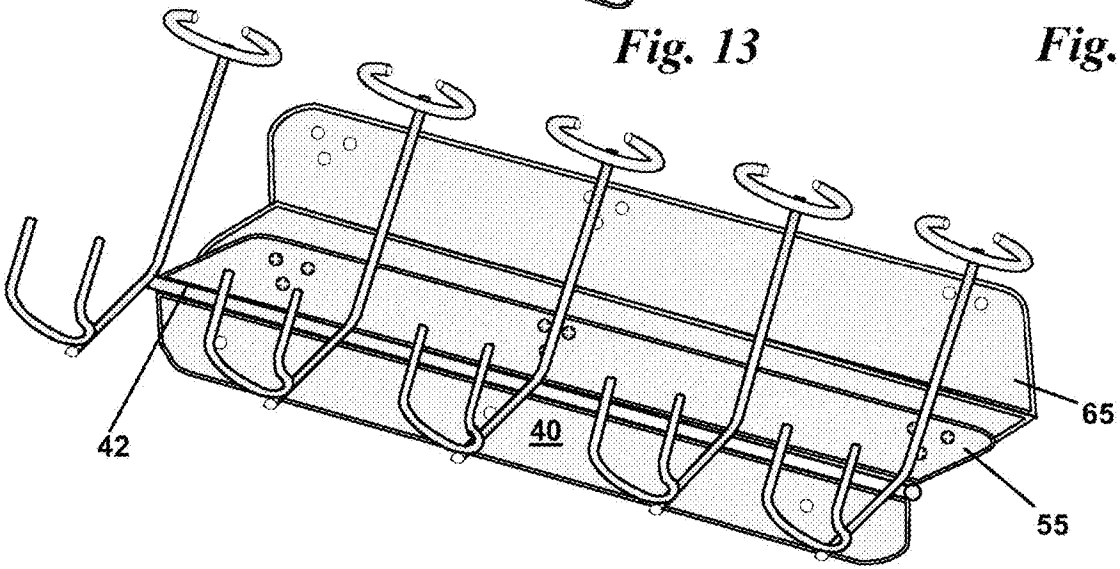
FIG. 14 is a perspective frontal view of a clipper holder rack having an L-angled plate that has five holders.

The rack in FIG. 14 has an L-angled plate 55 version of the generic mounting plate 40, wherein the rack has five clipper holders.

Figure 15:
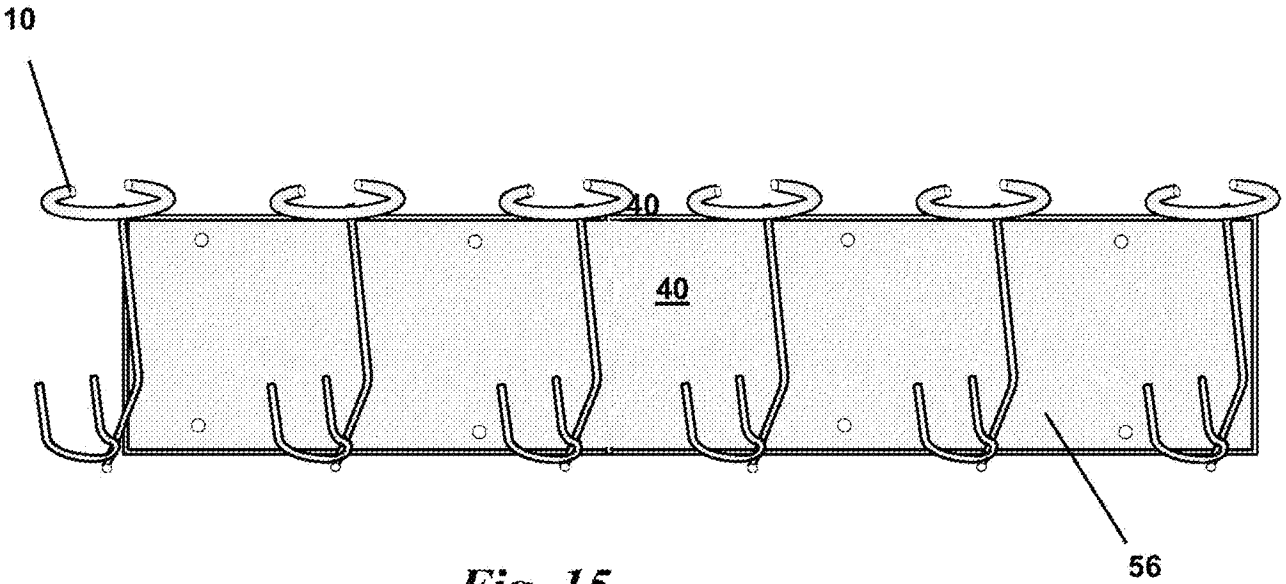
FIG. 15 is a perspective frontal view of a clipper holder rack having a planar plate that is mounted vertically, wherein the rack has six clipper holders.

A nominal upper number of holders is about nine. That said, the clipper holder in FIG. 15 has a rack with a planar plate 56 that is mounted vertically, wherein the rack has six clipper holders.

Figure 16:
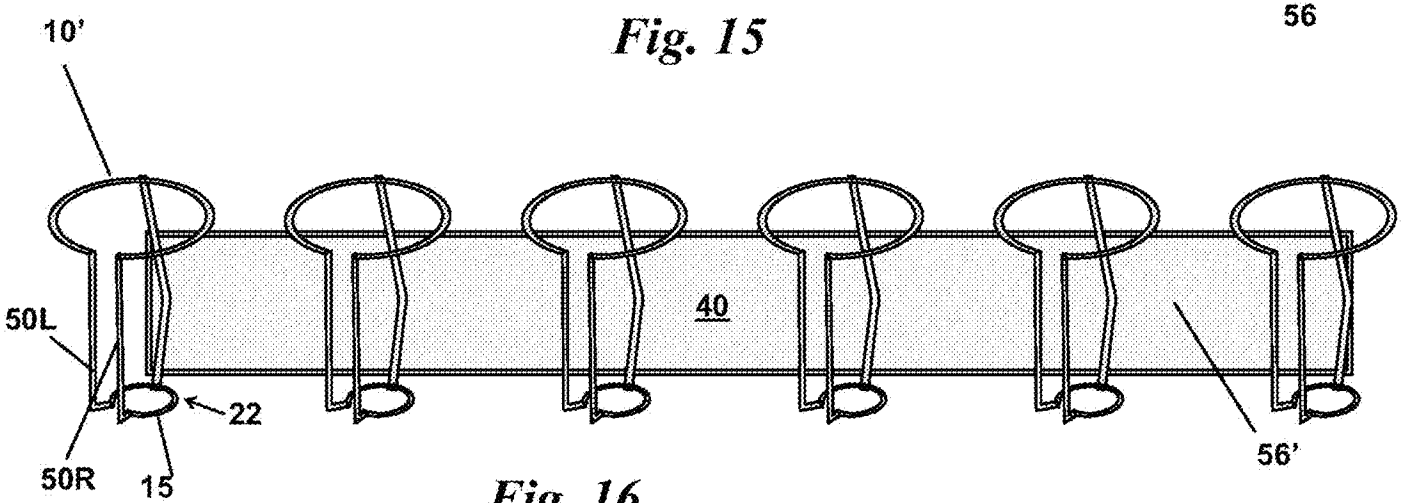
FIG. 16 is a perspective frontal view of a clipper holder rack having a planar plate that is mounted vertically, wherein the rack has six clipper holders with a left and a right frontal portion, as illustrated in FIG. 7.

A rack of clipper holders having parallel right and left frontal portions 50L, 50R and a lower enclosure 22 with a smaller major arc 15 is illustrated in FIG. 16. The rack of clipper holders 10' has six clipper holders 10' mounted vertically on an elongated plate 56' version of the mounting plate 40. The illustrated holders were previously shown in FIGS. 7-9 on as singles on mounting plate 40.

The rack of clipper holders can include any combination or variation of clipper holders 10, 10'.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A clipper holder rack for an electrical hair clipper having a upper body portion defining an upper body width and a lower body portion defining a lower body width and an electrical cord having a cord width, wherein said clipper holder rack comprises:

a mounting plate for mounting the clipper holder to a support surface, wherein the support surface can be vertical, horizontal, or angled; wherein the mounting plate has a front surface, a rear surface, a top, and a bottom, wherein the entire mounting plate is planar and the rear surface of the mounting plate is configured to abut the support surface; and at least one clipper holder, wherein each clipper holder comprises:

an upper enclosure comprised of a first metal wire formed into a major arc element that is greater than 180 degrees and less than 360 degrees with a first diameter that is greater than the upper body width of the electrical hair clipper, wherein a left half portion of the major arc element arcs rightward terminating in a left end, a right half portion of the major arc element arcs leftward terminating in a right end that is proximate to the left end, wherein an open space is formed between the left end and the right end, said open space defining an upper frontal opening for the upper enclosure; wherein the upper body portion of the electrical hair clipper is configured stored within the upper enclosure;

a lower enclosure having a second diameter that is smaller than the first diameter of the upper enclosure, wherein the lower enclosure is comprised of a second metal wire, said second metal wire formed into a semicircular arc element that is spaced apart from, generally parallel to, and generally coaxial with the major arc element of the upper enclosure, wherein the second diameter of the semicircular arc element is configured to support the lower body portion of the electrical hair clipper, a left side portion of the semicircular arc element is continuous with a left side curvilinear portion that extends forwardly from the left side portion of the semicircular arc element, wherein a distal portion the left side curvilinear portion curves upwardly toward the left end of the upper enclosure, wherein a left vertical straight extension is continuous with the distal portion of the left side curvilinear portion, wherein the left vertical straight extension is generally perpendicular with respect to the semicircular arc element; wherein a terminal end of the left vertical straight extension defines a left tip, a right side portion of the semicircular arc element is continuous with a right curvilinear side portion that extends forwardly from the right side portion of the semicircular arc element, wherein a distal portion the right side curvilinear portion curves upwardly toward the right end of the upper enclosure, wherein a right vertical straight extension is continuous with the distal portion of the right side curvilinear portion, wherein the right vertical straight extension is generally perpendicular with respect to the semicircular arc element; wherein a terminal end of the right vertical straight extension defines a right tip, wherein the right vertical straight extension is generally parallel to the left vertical extension, and a slot is formed between the left vertical straight extension and the right vertical straight extension, wherein the slot defines a lower frontal opening that is wide enough to allow passage of the cord width of the electrical cord of the electrical hair clipper, wherein the left and right vertical straight extensions retain the hair clipper and prevents the hair clipper from moving forward; and an angled rear rod comprising an inclined upper section terminating in a upper end, an inclined lower section terminating in a lower end, and a midsection; wherein the inclined upper section extends diagonally upward from the midsection and the inclined lower section extends diagonally downward from the midsection; wherein the midsection defines an apex wherein the angled rear rod is bent at the apex to form the inclined upper section and the inclined lower section; wherein a top portion of the inclined upper section is attached to the upper enclosure, and a bottom portion of the inclined lower section is attached to the lower enclosure wherein the apex of the angled rear rod is mounted directly to the mounting plate or components of the mounting plate.

2. The clipper holder rack according to claim 1, wherein the first diameter of the major arc element of the upper enclosure is about 1.25 inches to about 2.75 inches.

3. The clipper holder rack according to claim 1, wherein the second diameter of the semicircular arc element of the lower enclosure is about 0.875 inches to about 1.25 inches.

4. The clipper holder rack according to claim 1, wherein the first metal wire of the upper enclosure and the second metal wire of the lower enclosure each have a gauge that is about 6±about 2.

5. The clipper holder rack according to claim 1, wherein the first metal wire and the second metal wire are each made of steel.

6. The clipper holder rack according to claim 1, wherein the at least one clipper holder comprises two clipper holders that are each mounted to the mounting plate.

7. The clipper holder rack according to claim 6, wherein the two clipper holders are spaced from each other.

* * * * *